US009044980B2

(12) United States Patent
Kumazaki

(10) Patent No.: US 9,044,980 B2
(45) **Date of Patent: *Jun. 2, 2015**

(54) PLATEN GAP ADJUSTMENT MECHANISM

(71) Applicant: SEIKO EPSON CORPORATION, Tokyo (JP)

(72) Inventor: Masayuki Kumazaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/147,592

(22) Filed: Jan. 6, 2014

(65) Prior Publication Data

US 2014/0119801 A1 May 1, 2014

Related U.S. Application Data

(62) Division of application No. 13/491,831, filed on Jun. 8, 2012, now Pat. No. 8,651,603.

(30) Foreign Application Priority Data

Jun. 16, 2011 (JP) ..... 2011-133938

(51) Int. Cl.
*B41J 2/165* (2006.01)
*B41J 25/308* (2006.01)

(52) U.S. Cl.
CPC ..... *B41J 25/3088* (2013.01); *B41J 25/3082* (2013.01)

(58) Field of Classification Search
None
See application file for complete search history.

(56) References Cited

U.S. PATENT DOCUMENTS

| | | | | |
|---|---|---|---|---|
| 4,420,269 | A | 12/1983 | Ackermann et al. | |
| 5,065,169 | A | 11/1991 | Vincent et al. | |
| 5,090,825 | A | 2/1992 | Merriman, Jr. et al. | |
| 5,156,466 | A | 10/1992 | Inagaki et al. | |
| 5,887,987 | A | 3/1999 | Sawano | |
| 8,651,603 | B2 * | 2/2014 | Kumazaki | 347/8 |

FOREIGN PATENT DOCUMENTS

| | | | |
|---|---|---|---|
| DE | 3112079 | A1 | 11/1982 |
| JP | 1204769 | A | 8/1989 |

(Continued)

OTHER PUBLICATIONS

Extended European Search Report corresponding to EP12168039.1, dated Oct. 24, 2012.

*Primary Examiner* — Alejandro Valencia
(74) *Attorney, Agent, or Firm* — Lowe Hauptman & Ham, LLP

(57) ABSTRACT

A platen gap adjustment mechanism includes a carriage guide shaft, a carriage drive unit and a main carriage. The carriage guide shaft is configured to extend perpendicularly to a media conveyance direction that passes over a platen. The carriage drive unit is supported on the carriage guide shaft and pivotable around an axis of the carriage guide shaft. The main carriage is supported on the carriage drive unit, pivotable around a parallel axis that is parallel to the axis of the carriage guide shaft, and configured to carry a printhead for printing on a print medium conveyed along the media conveyance path past the platen. The main carriage is moveable toward and away from the platen according to a thickness of the print medium while being slidable in sliding contact with the print medium conveyed over the platen to maintain a constant gap between the printhead and the print medium.

13 Claims, 5 Drawing Sheets

(56) References Cited

FOREIGN PATENT DOCUMENTS

| | | | |
|---|---|---|---|
| JP | 6127060 | A | 5/1994 |
| JP | 9202017 | A | 8/1997 |
| JP | 2924021 | B2 | 7/1999 |
| JP | 200171581 | A | 3/2001 |
| JP | 2003159851 | A | 6/2003 |
| JP | 200450539 | A | 2/2004 |

* cited by examiner

PLATEN GAP ADJUSTMENT MECHANISM

This application is a divisional of and claims priority to U.S. patent application Ser. No. 13/491,831, entitled Platen Gap Adjustment Mechanism And Printer, filed on Jun. 8, 2012, listing Masayuki Kumazaki as an inventor, the entire contents of that application being incorporated herein by reference in its entirety.

RELATED APPLICATION(S)

The instant application claims the benefit of Japanese patent application No. 2011-133938 filed Jun. 16, 2011 the entire disclosure of which is incorporated by reference herein.

BACKGROUND

1. Technical Field

The present disclosure relates to a platen gap adjustment mechanism and to a printer having the platen gap adjustment mechanism.

2. Related Art

In order to print on a page in a booklet, such as a passbook, the booklet is opened to expose the page to be printed on. The open booklet is then conveyed along a media conveyance path past a platen, and a printhead prints on the exposed page as the booklet passes the platen. The thickness of the open booklet therefore changes when the page to be printed on changes, i.e., when the booklet is opened to a different position. More specifically, the thickness of the print medium conveyed over the platen varies and depends upon the print job.

If the printer has a constant platen gap between the printhead and the platen, print quality might drop when the thickness of the print medium changes because the gap between the printhead and the print medium changes. Printers having a platen gap adjustment mechanism that moves the printhead vertically according to the thickness of the print medium conveyed over the platen are therefore used when print media of different thicknesses are used.

A printer with a platen gap adjustment mechanism is described in Japanese Unexamined Patent Application Publication JP-A-H09-202017. The printer in JP-A-H09-202017 enables a carriage that carries the printhead to pivot about the axis of a carriage guide shaft that supports the carriage. The carriage pivots up and down according to the thickness of the print medium by causing the bottom surface of the carriage to slide over the print medium passing the platen, thus causing the printhead to move vertically and suppressing variation in the gap between the printhead and the print medium.

The inventor(s) has recognized that, in the printer described in JP-A-H09-202017, the carriage tilts when the carriage pivots up or down from the reference position according to the thickness of the print medium, and the printhead carried on the carriage therefore becomes tilted relative to the printing surface of the print medium passing over the platen. When using a serial impact dot matrix printhead, which prints by striking an ink ribbon with the recording wires of the printhead and transferring ink from the ink ribbon onto continuous paper used as the print medium, print quality might drop when the printhead becomes inclined to the printing surface because the distance the recording wires (printing pins) travel to the printing surface changes.

If the platen gap adjustment mechanism has a lift mechanism that moves the carriage guide shaft vertically, and moves the carriage guide shaft up or down based on the thickness of the print medium passing the platen, the printhead mounted on the carriage can be moved up and down without tilting relative to the printing surface of the print medium. In this configuration, the carriage guide shaft, carriage, and printhead are moved up and down together, i.e., the weight of the driven members increases, and a motor or another drive unit might be used as the lifting mechanism. A sensor for detecting the thickness of the print medium might also be used which might complicate the device configuration and control or lead to an increase in the manufacturing cost of the printer.

SUMMARY

In accordance with some embodiments of the invention, a platen gap adjustment mechanism comprises a carriage guide shaft, a carriage drive unit and a main carriage. The carriage guide shaft is configured to extend perpendicularly to a media conveyance direction that passes over a platen. The carriage drive unit is supported on the carriage guide shaft and pivotable around an axis of the carriage guide shaft. The main carriage is supported on the carriage drive unit, pivotable around a parallel axis that is parallel to the axis of the carriage guide shaft, and configured to carry a printhead for printing on a print medium conveyed along the media conveyance path past the platen. The main carriage is moveable toward and away from the platen according to a thickness of the print medium while being slidable in sliding contact with the print medium conveyed over the platen to maintain a constant gap between the printhead and the print medium.

In accordance with some embodiments of the invention, a printer comprises a platen, a printhead, a media conveyance path passing between the printhead and the platen, and the above described platen gap adjustment mechanism.

In accordance with some embodiments of the invention, a platen gap adjustment mechanism comprises a carriage guide shaft, a carriage drive unit, a main carriage and a sub-carriage. The carriage drive unit is supported on the carriage guide shaft and pivotable around an axis of the carriage guide shaft. The main carriage is supported on the carriage drive unit, pivotable around a parallel axis that is parallel to the axis of the carriage guide shaft, and configured to carry a printhead for printing on a print medium conveyed along a media conveyance path between the printhead and a platen. The sub-carriage is supported on the carriage drive unit and pivotable around the axis of the carriage guide shaft independently of a rotational movement of the carriage drive unit about the axis of the carriage guide shaft. The main carriage is slidable on the sub-carriage toward and away from the platen.

DESCRIPTION OF EMBODIMENTS

A printer having a platen gap adjustment mechanism according to some embodiments of the invention will be described below with reference to the accompanying figures.

General Configuration

Figure 1A:
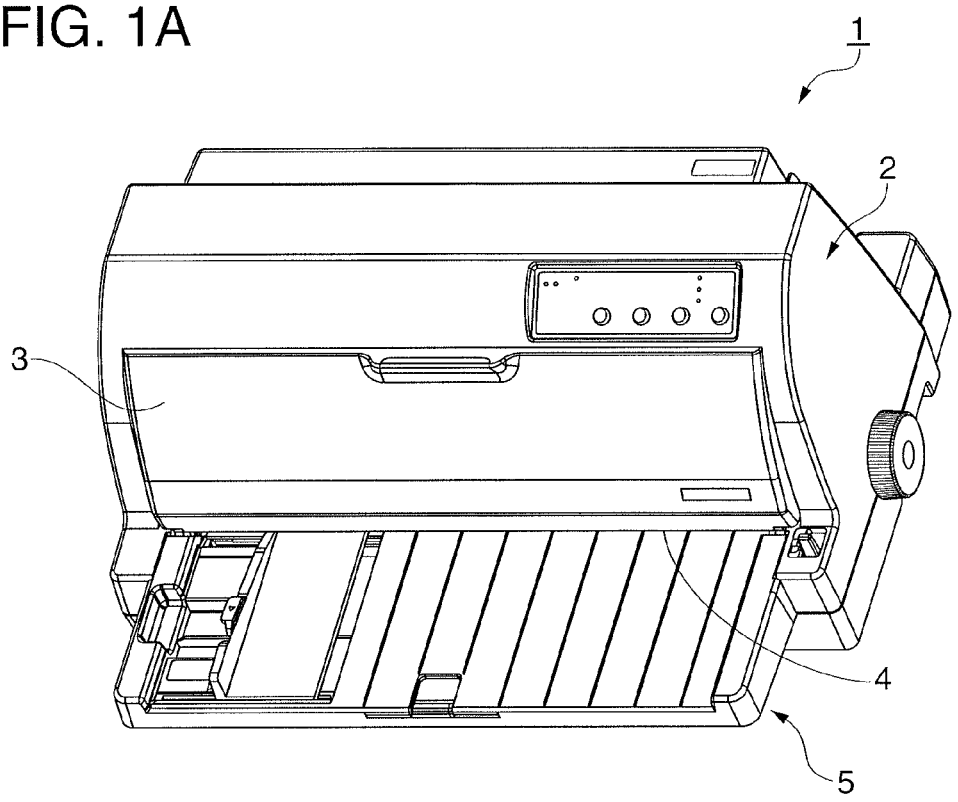
FIG. 1A is a perspective view and FIG. 1B is a section view of a printer with a platen gap adjustment mechanism according to some embodiments of the invention.
Figure 1B:
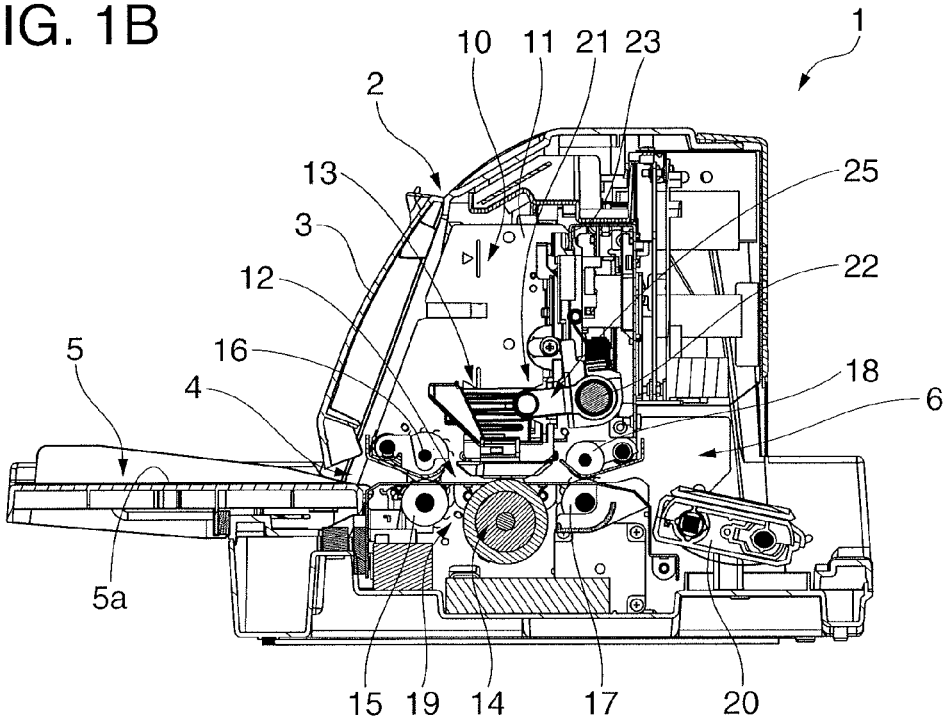
Figure 2:
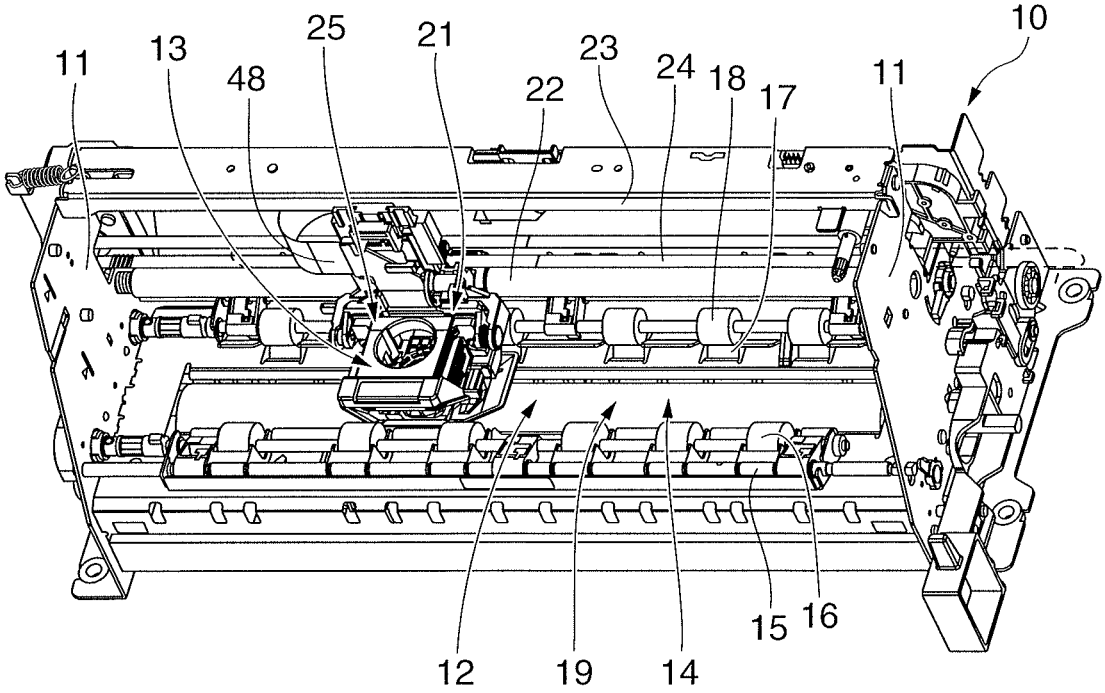
FIG. 2 is a perspective view of a printer frame of the printer of FIG. 1.

FIG. 1A is a perspective view of a printer 1 according to some embodiments of the invention, and FIG. 1B is a vertical section view of the printer 1. FIG. 2 is a perspective view of a printer frame 10 of the printer 1.

As shown in FIG. 1A, the printer 1 has a main unit 2 that is elongated from side to side. A media opening 4 of a specific width is formed in the front of the case 3 of the main unit 2, and a media guide 5 projects to the front of the printer below the media opening 4. A media entrance 6 for inserting continuous paper is formed in the back of the case 3 as shown in FIG. 1B.

The main unit 2 has the printer frame 10 inside the case 3. As shown in FIG. 2, the printer frame 10 has a pair of side walls 11 extending vertically on opposite sides in the printer width. A media conveyance path 12 extending in the front-back direction between the media opening 4 and the media entrance 6 is disposed between the side walls 11 as shown in FIG. 1B. The top 5*a* of the media guide 5 is continuous to the media conveyance path 12.

A platen roller 14 that defines the printing position of the printhead 13 is disposed with its axis of rotation perpendicular to the media conveyance direction in the middle of the media conveyance path 12. A front paper feed roller 15 is located in front of the platen roller 14. A front pressure roller 16 is pressed with a specific amount of pressure to the front paper feed roller 15 from above. A back paper feed roller 17 is located behind the platen roller 14. A back pressure roller 18 is pressed with a specific amount of pressure to the back paper feed roller 17 from above. The platen roller 14, front paper feed roller 15, front pressure roller 16, back paper feed roller 17, and back pressure roller 18 are disposed to the printer frame 10 parallel to the media conveyance path 12. The platen roller 14, front paper feed roller 15, and back paper feed roller 17 define a media conveyance mechanism 19 for conveying the print medium along the media conveyance path 12, and are driven by a conveyance motor (not shown) mounted on the printer frame 10. A tractor unit 20 for conveying continuous paper is located behind the back pressure roller 18.

The printhead 13, the carriage 21 that carries the printhead 13, and the carriage guide shaft 22 and guide member 23 that guide the carriage 21 in a widthwise direction of the printer, are disposed above the media conveyance path 12. A timing belt 24 and a carriage motor (not shown in the figure) for moving the carriage 21 bi-directionally along the carriage guide shaft 22, and a guide member 23 are also located above the media conveyance path 12.

The printhead 13 and carriage 21 are located directly above the platen roller 14. The printhead 13 in one or more embodiments of the invention is a serial impact dot matrix printhead that prints by striking an ink ribbon with recording wires (e.g., printing pins) to transfer ink from the ink ribbon to the print medium, and the ink ribbon (not shown in the figure) exposed from the ink ribbon cartridge is inserted between the printhead 13 and platen roller 14.

The carriage guide shaft 22 is located in opposition to the media conveyance path 12 at a position behind the platen roller 14, is parallel to the platen roller 14, and extends between the pair of side walls 11 of the printer frame 10. The axis L1 of the carriage guide shaft 22 extends in a direction perpendicular to the media conveyance direction. The guide member 23 is a flat member of a constant thickness, and extends between the pair of side walls 11 of the printer frame 10 parallel to the platen roller 14 and the carriage guide shaft 22 at a position directly above the carriage guide shaft 22 (i.e., the carriage guide shaft 22 is located between the guide member 23 and the media conveyance path 12).

A platen gap adjustment mechanism 25, which causes the printhead 13 to move up and down (i.e., toward and away from the platen roller 14) tracking the thickness of the print medium conveyed over the platen roller 14 along the media conveyance path 12, is disposed to the carriage 21.

The printer 1 according to one or more embodiments of the invention is configured to selectively perform two printing operations. The first printing operation conveys a print medium inserted from the media opening 4 at the front of the printer along the media conveyance path 12 toward the back of the printer, prints at the printing position, and then conveys the print medium to the front and discharges it from the media opening 4. The second printing operation conveys a print medium inserted from the media entrance 6 at the back of the printer along the media conveyance path 12 toward the front, prints at the printing position, and then discharges the print medium from the media opening 4.

The first printing operation is selected when printing on a page of a booklet, such as a passbook, for example. More specifically, to print on a page of the booklet, the booklet is opened to expose the page for printing. The open booklet is then inserted along the media guide 5 from the media opening 4 into the media conveyance path 12 with the exposed page facing up. When the booklet is inserted to the media conveyance path 12, the conveyance motor is driven and the booklet is conveyed by the media conveyance mechanism 19 along the media conveyance path 12 toward the back of the printer. When the booklet passes over the platen roller 14, the printhead 13 prints on the exposed page. When printing ends, the conveyance motor is driven in reverse, and the booklet is thereby conveyed by the media conveyance mechanism 19 to the front and discharged from the media opening 4.

The second printing operation is selected when printing on fanfold paper, for example. More specifically, fanfold paper is inserted through the tractor unit 20 from the media entrance 6 at the back of the printer to the media conveyance path 12. When fanfold paper is inserted to the media conveyance path 12, the conveyance motor is driven and the fanfold paper is conveyed by the media conveyance mechanism 19 along the media conveyance path 12 to the front. The printhead 13 prints as the fanfold paper passes over the platen roller 14. The printed fanfold paper continues being conveyed to the front, and is discharged from the media opening 4.

Platen Gap Adjustment Mechanism

Figure 3A:
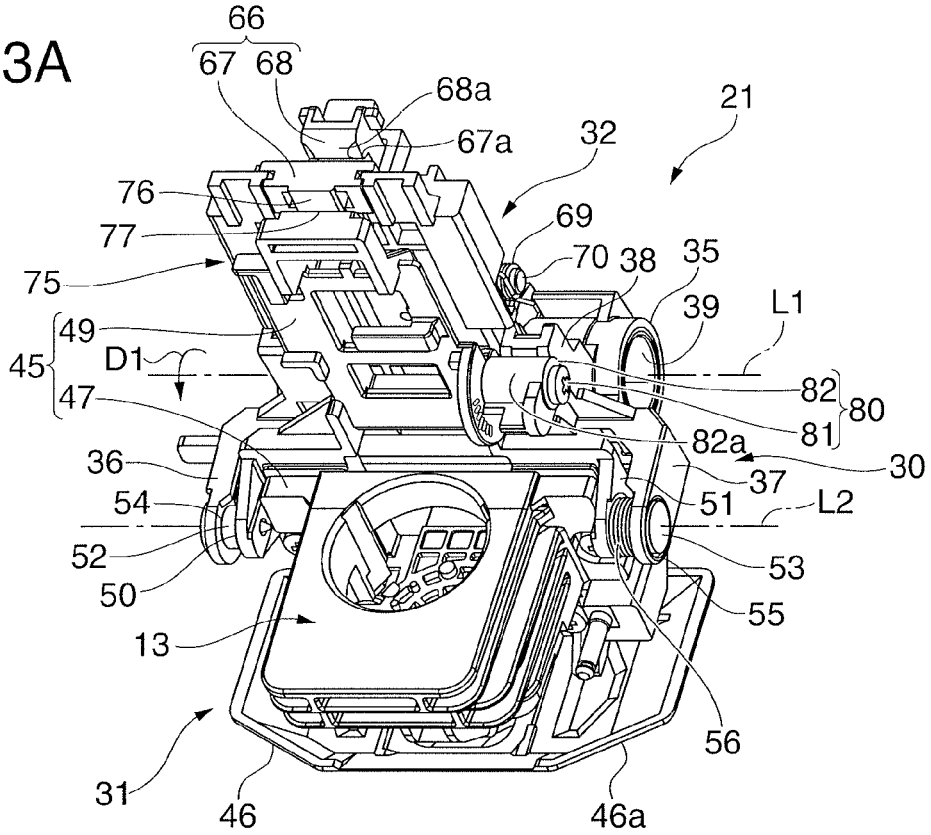
FIG. 3A is a top perspective view and FIG. 3B is a bottom perspective view of a carriage that carries a printhead of the printer of FIG. 1.
Figure 3B:
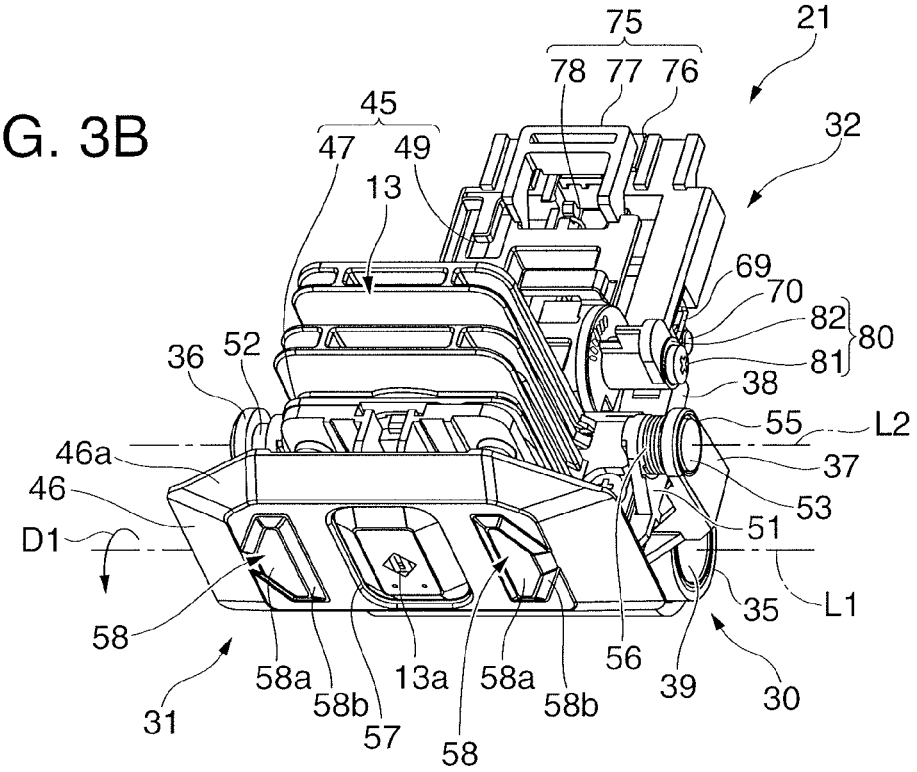
Figure 4A:
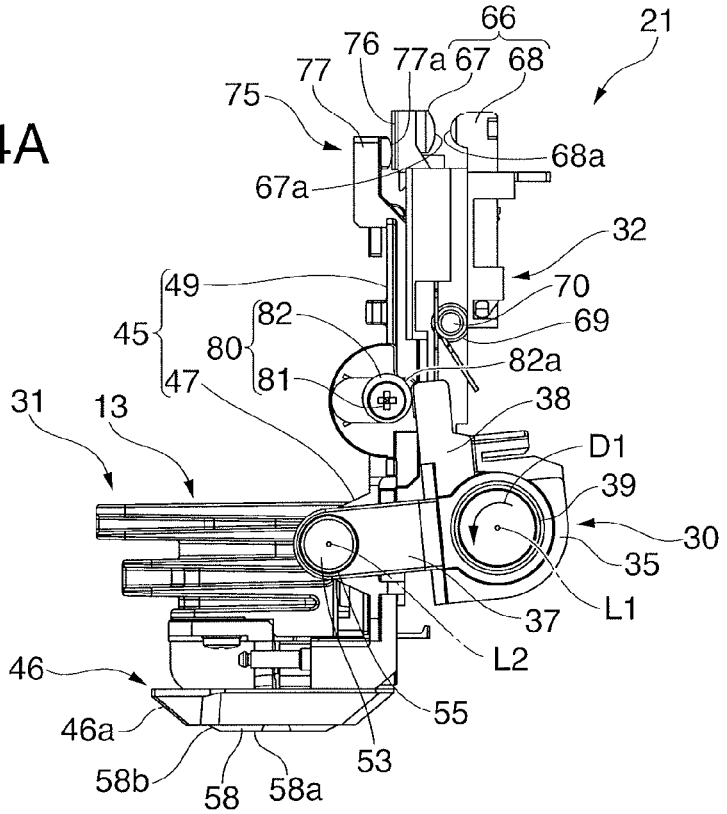
FIG. 4A is a side view and FIG. 4B is a section view of the carriage.
Figure 4B:
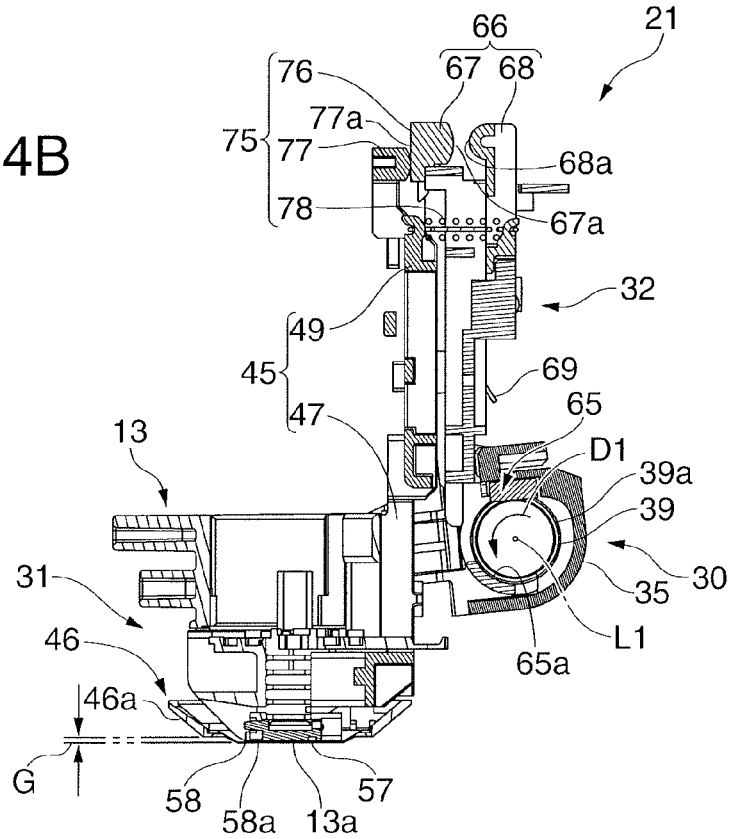

The platen gap adjustment mechanism 25 is described next with reference to FIG. 2 to FIG. 5. FIG. 3A is a perspective view of the carriage 21 from above, and FIG. 3B is a perspective view of the carriage 21 from below. FIG. 4A is a side view of the carriage 21, and FIG. 4B is a vertical section view of the carriage 21.

The carriage 21 includes a carriage drive unit 30 that is supported by the carriage guide shaft 22, a main carriage 31 that is supported by the carriage drive unit 30, and a sub-carriage 32 that is supported by the carriage drive unit 30 and extends between the carriage drive unit 30 and the guide member 23.

The carriage drive unit 30 is made, in one or more embodiments, of aluminum, and includes a tubular part 35 elongated in the widthwise direction of the printer 1, a pair of arms 36, 37 that project toward the front of the printer from the opposite ends of the tubular part 35, and a stop 38 that is disposed to the tubular part 35 between the pair of arms 36, 37 and extends from a position closer to one arm 37 than to the other arm 36 and in a direction perpendicular to the arm 37. A tubular bushing 39 is pressed into the center hole of the tubular part 35, and the carriage guide shaft 22 is inserted into the center hole of the bushing 39. By inserting the carriage guide shaft 22 into the center hole of the bushing 39, the carriage drive unit 30 is supported by the carriage guide shaft 22 movably along the axis L1 of the carriage guide shaft 22 while being pivotable around the axis L1. The timing belt 24 is connected to the carriage drive unit 30, and when the timing belt 24 is driven by driving the carriage motor, the carriage drive unit 30 moves in the widthwise direction of the printer 1 along the carriage guide shaft 22.

The main carriage 31 includes an aluminum carriage base 45 for mounting the printhead 13, and a plastic ribbon mask (mask) 46 attached to the bottom end of the carriage base 45.

The carriage base 45 includes a head mounting unit 47 to which the printhead 13 is mounted, and a flexible printed circuit (FTC) mounting unit 49 that extends up from the back end part of the head mounting unit 47. A flexible printed circuit 48 (see FIG. 2) connected to the printhead 13 is attached to the FPC mounting unit 49. The printhead 13 is mounted on the head mounting unit 47 with the printhead surface 13*a* in which the recording wires are arrayed facing down (see FIG. 4B).

The main carriage 31 is supported on the carriage drive unit 30 so that the main carriage 31 is pivotable around a parallel axis L2 that is parallel to the axis L1 of the carriage guide shaft 22. More specifically, the main carriage 31 is disposed with the head mounting unit 47 between the pair of arms 36, 37 of the carriage drive unit 30, and shaft parts 52, 53 projecting in the widthwise direction of the printer 1 are disposed to the head mounting unit 47 in opposing faces 50, 51 opposite the pair of arms 36, 37. Round through-holes 54, 55 that function as bearings for the shaft parts 52, 53 are formed in the distal ends of the pair of arms 36, 37. The main carriage 31 is pivotably supported by the carriage drive unit 30 by inserting the shaft parts 52, 53 to the corresponding round through-holes 54, 55. Parallel axis L2 is the center axis of the shaft parts 52, 53 and through-holes 54, 55. An urging member 56 that urges the head mounting unit 47 to the other side in the widthwise direction of the printer 1 is disposed between one opposing face 51 of the main carriage 31 and the corresponding arm 37 of the carriage drive unit 30. In one or more embodiments of the invention the urging member 56 is a coil spring that is fit around the outside of the shaft part 53. The urging member 56 prevents the main carriage 31 from shifting in the widthwise direction of the printer 1 on the carriage drive unit 30.

The ribbon mask 46 is a narrow plate that is elongated in the widthwise direction of the printer 1. A window 57 is formed in the widthwise center part of the ribbon mask 46. The window 57 exposes the printhead surface 13*a* of the printhead 13 to the platen roller 14 below. A pair of protruding parts 58 protrude from the bottom of the ribbon mask 46 with the window 57 therebetween in the widthwise direction of the printer 1. Each of the protruding parts 58 has a flat bottom surface 58*a* (i.e., the surface facing the platen roller 14), and sides 58*b* that slope upwardly and outwardly from the outside edges of the bottom surface 58*a*. The bottom surface 58*a* is a sliding surface that is slidable in sliding contact with the printed surface of the print medium conveyed over the platen roller 14.

The distance from the bottom surface 58*a* (sliding surface) of the ribbon mask 46 to the printhead surface 13*a* of the printhead 13 exposed through the window 57 is the gap G from the printed surface of the print medium conveyed over the platen roller 14 to the printhead surface 13*a* of the printhead 13 (FIG. 4B). The outside edge part of the ribbon mask 46 is a slope 46*a* that slopes outwardly and upwardly. The ink ribbon is disposed along the top surface of the ribbon mask 46 and passes below the printhead surface 13*a* of the printhead 13.

The sub-carriage 32 is plastic, and as shown in FIG. 4B has at the lower end a lower attachment part 65 attached to the carriage drive unit 30. The lower attachment part 65 has a curved inside surface 65*a* that fits part of the round outside surface 39*a* of the bushing 39 of the carriage drive unit 30. The sub-carriage 32 is positioned and attached to the carriage drive unit 30 by fitting the lower attachment part 65 to the bushing 39 with the curved inside surface 65*a* in contact with the round outside surface 39*a* of the bushing 39. When the sub-carriage 32 is attached to the carriage drive unit 30, the sub-carriage 32 is pivotable around the axis L1 of the carriage guide shaft 22 independently of a rotational movement of the carriage drive unit 30 about the carriage guide shaft 22.

The sub-carriage 32 also has at the upper end part thereof an upper attachment part 66 attached to the guide member 23. The upper attachment part 66 has a front slider 67 and a back slider 68 protruding in the front-back direction of the printer with a specific gap therebetween. The back face 67*a* of the front slider 67 opposite the back slider 68 has a curved surface protruding toward the back of the printer when seen in section in line with the axis L1 of the carriage guide shaft 22, and the front face 68*a* of the back slider 68 opposite the front slider 67 has a curved surface protruding toward the front of the printer when seen in section in line with the axis L1 of the carriage guide shaft 22. The sub-carriage 32 is disposed to the guide member 23 by inserting the guide member 23 between the front slider 67 and back slider 68.

When the lower attachment part 65 is attached to the carriage drive unit 30 and the upper attachment part 66 is installed to the guide member 23, the sub-carriage 32 extends between carriage drive unit 30 and the guide member 23. When the carriage motor is then driven and the carriage drive unit 30 moves along the carriage guide shaft 22, the sub-carriage 32 moves with the carriage drive unit 30 along the carriage guide shaft 22. Because the top end part of the sub-carriage 32 moves along the guide member 23 parallel to the carriage guide shaft 22 when the sub-carriage 32 moves with the carriage drive unit 30, the posture of the sub-carriage 32 does not change and the same posture is constantly maintained. In addition, even if the carriage drive unit 30 pivots around the axis L1 when the carriage drive unit 30 moves in the direction of axis L1 along the carriage guide shaft 22, the rotational movement of the carriage drive unit 30 does not affect the posture of the sub-carriage 32, and the posture of the sub-carriage 32 does not change, because the sub-carriage 32 is pivotable independently of the carriage drive unit 30 around the axis L1 of the carriage guide shaft 22.

An urging member (second urging member) 69 that urges the main carriage 31 toward the platen roller 14 by urging the carriage drive unit 30 in a first rotational direction D1 around the axis L1 of the carriage guide shaft 22 (the direction causing the pair of arms 36, 37 to rotate down) is also disposed to the sub-carriage 32. The urging member 69 in one or more embodiments of the invention is a pair of torsion springs, is attached to a pair of protrusions 70 that protrude outwardly in the widthwise direction of the printer 1 from the sides of the sub-carriage 32, and urges the carriage drive unit 30 in the first rotational direction D1. The main carriage 31 is slidable against the print medium conveyed over the platen roller 14 without a gap being formed therebetween due to the urging force of the urging member 69 and the weight of the main carriage 31 and printhead 13.

A slide mechanism 75 is defined between the sub-carriage 32 and the main carriage 31 so that the main carriage 31 is moveable up and down vertically without changing its posture.

The slide mechanism 75 has a slide guide surface 76 formed on the front of the top part of the sub-carriage 32, a slide bump 77 that protrudes toward the back of the printer from the top end part of the FPC mounting unit 49 of the main carriage 31, and an urging member (first urging member) 78 that causes the slide bump 77 to slide against the slide guide surface 76. The slide guide surface 76 is formed toward the back of the printer from the parallel axis L2, and is disposed perpendicularly to the platen roller 14 when the sub-carriage 32 is mounted between the guide member 23 and carriage drive unit 30. When seen in line with the axis L1 of the carriage guide shaft 22, the shape of the rear surface 77*a* of the slide bump 77 is a curved surface that protrudes toward the back of the printer. The urging member 78 is disposed between the FPC mounting unit 49 of the main carriage 31 and the sub-carriage 32, and urges the FPC mounting unit 49 of the main carriage 31 toward the sub-carriage 32.

A pivot range limiting part 80, which contacts the stop 38 of the carriage drive unit 30 and limits the range of rotational movement of the carriage drive unit 30 in the first rotational direction D1 around the axis L1 of the carriage guide shaft 22, is disposed to the main carriage 31. The pivot range limiting part 80 has a shaft 81 (support shaft) protruding outwardly from one side of the main carriage 31, and an eccentric bushing 82 rotatably attached to the shaft 81. The outside surface of the eccentric bushing 82 is a contact surface 82*a* that is configured to contact the stop 38 of the carriage drive unit 30. Because the contact surface 82*a* of the eccentric bushing 82 moves toward and away from the shaft 81 when the eccentric bushing 82 turns, contact between the contact surface 82*a* and the stop 38 therefore moves toward the front or the back of the printer. As a result, the pivot range in which the carriage drive unit 30 is pivotable in the first rotational direction D1 around the axis L1 of the carriage guide shaft 22 is adjustable by a rotational position of the eccentric bushing 82 relative to the shaft 81.

Platen Gap Adjustment Operation

Figures 5A, 5B, 5C:
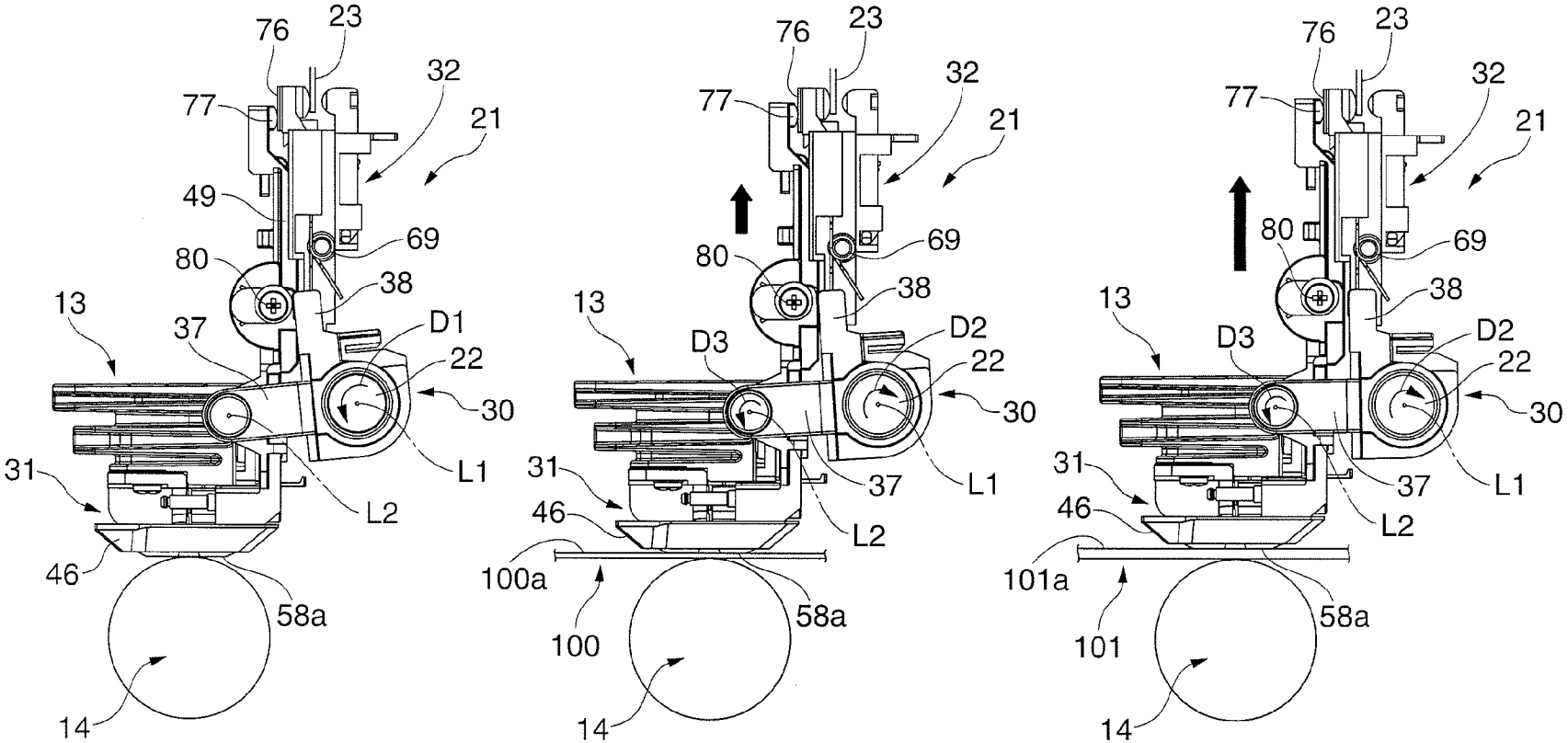
FIGS. 5A-5C are side views similar to FIG. 4A and describing the platen gap adjustment operation in accordance with some embodiments.

FIGS. 5A-5C are side views similar to FIG. 4A and describing the platen gap adjustment operation, FIG. 5A showing the initial state when a print medium is not on the platen roller 14, FIG. 5B showing a state when a print medium of a first thickness is conveyed over the platen roller 14, and FIG. 5C showing another state when a print medium of a second thickness that is greater than the first thickness is conveyed over the platen roller 14.

In the initial state as shown in FIG. 5A, there is a slight gap between the platen roller 14 and main carriage 31. More specifically, the carriage drive unit 30 is urged in the first rotational direction D1 around the axis L1 of the carriage guide shaft 22 by the urging member 69 disposed to the sub-carriage 32 and pivots down with the front of the pair of arms 36, 37 sloping down. The parallel axis L2, which is the pivot axis of the main carriage 31, is therefore lower than the axis L1 of the carriage guide shaft 22. The stop 38 of the carriage drive unit 30 is also touching the pivot range limiting part 80 disposed to the main carriage 31, and rotation of the carriage drive unit 30 in the first rotational direction D1 is stopped. The FPC mounting unit 49 of the main carriage 31 is also urged by the urging member 78 toward the sub-carriage 32 (FIG. 4B), the slide bump 77 is touching the slide guide surface 76 of the sub-carriage 32, and the main carriage 31 is thereby held in a specific posture while moving toward and away from the platen roller 14. The printhead 13 mounted on the main carriage 31 is therefore held in a specific posture with the printhead surface 13*a* parallel to the platen roller 14.

When a booklet or other print medium 100 of a first thickness is then conveyed along the media conveyance path 12 from this position as shown in FIG. 5B and the print medium 100 passes over the platen roller 14, the top printing surface 100*a* of the print medium 100 and the bottom surfaces 58*a* of the main carriage 31 (the bottom surfaces 58*a* of the protruding parts 58 of the ribbon mask 46) slide against each other, and push the main carriage 31 up. As a result, the carriage drive unit 30 carrying the main carriage 31 pivots about the axis L1 of the carriage guide shaft 22 in a second rotational direction D2 opposite the first rotational direction D1 against the urging force of the urging member 69.

When the carriage drive unit 30 pivots in the second rotational direction D2 around the axis L1 of the carriage guide shaft 22, the main carriage 31 moves up with the slide bump 77 sliding against the slide guide surface 76 of the sub-carriage 32 perpendicular to the platen roller 14. As a result, the main carriage 31 pivots in a third rotational direction D3 opposite the second rotational direction D2 around parallel axis L2 instead of rotating with the carriage drive unit 30 in the second rotational direction D2 around the axis L1 of the carriage guide shaft 22, and maintains the same posture as in the initial state of FIG. 5A. The printhead 13 mounted on the main carriage 31 is therefore held in the same specific posture with the printhead surface 13*a* parallel to the platen roller 14.

The distance the printing pins (recording wires) travel to the printing surface 100*a* therefore remains the same when the printhead 13 moves up and down according to the thickness of the print medium 100 conveyed over the platen roller 14 because the printhead surface 13*a* of the printhead 13 does not tilt relative to the printing surface 100*a*. The distance the printing pins (recording wires) travel to the printing surface 100*a* is therefore held at a desirable distance because the gap G from the printhead surface 13*a* of the printhead 13 to the printing surface 100*a* of the print medium 100 is the distance from the bottom surfaces 58*a* (sliding surface) of the protruding parts 58 of the ribbon mask 46 that slide against the printing surface 100*a* to the printhead surface 13*a* of the printhead 13. It is therefore possible to avoid a drop in print quality caused by the platen gap adjustment operation.

When a print medium 101 of a second thickness that is greater than the first thickness is then conveyed along the media conveyance path 12 from this position as shown in FIG. 5C, the platen gap is again adjusted as described above. More specifically, when the print medium 101 passes over the platen roller 14, the top printing surface 101*a* of the print medium 101 and the bottom surfaces 58*a* of the main carriage 31 slide against each other, and push the main carriage 31 up. As a result, the carriage drive unit 30 carrying the main carriage 31 pivots in the second rotational direction D2 about the axis L1 of the carriage guide shaft 22. The distance the carriage drive unit 30 rotates in this case is greater than when a print medium 100 of the first thickness is conveyed over the platen roller 14.

When the carriage drive unit 30 rotates in the second rotational direction D2 around the axis L1 of the carriage guide shaft 22, the main carriage 31 moves up with the slide bump 77 sliding against the slide guide surface 76 of the sub-carriage 32 perpendicular to the platen roller 14. As a result, the main carriage 31 pivots around parallel axis L2 in a third rotational direction D3 opposite the second rotational direction D2 instead of rotating with the carriage drive unit 30 in the second rotational direction D2 around the axis L1 of the carriage guide shaft 22, and maintains the same posture as in the initial state of FIG. 5A. More specifically, the main carriage 31 rotates in the third rotational direction D3 around the parallel axis L2 a greater amount than when a print medium 100 of the first thickness is conveyed past the platen roller 14, and still maintains the same posture. The printhead 13 mounted on the main carriage 31 is therefore held in the same specific posture with the printhead surface 13*a* parallel to the platen roller 14.

As a result, even when the thickness of the print medium 101 increases, the printhead surface 13*a* of the printhead 13 does not tilt relative to the printing surface 101*a* when the printhead 13 moves vertically tracking the thickness of the print medium 101 conveyed over the platen roller 14. In addition, the distance from the printhead surface 13*a* of the printhead 13 to the printing surface 101*a* of the print medium 101 is the distance from the bottom surface 58*a* (sliding surface) of the protruding part 58 of the ribbon mask 46 that slides against the printing surface 101*a* to the printhead surface 13*a* of the printhead 13, and does not change. As a result, it is possible to avoid a drop in print quality due to the platen gap adjustment operation.

Other Embodiments

A pivot range limiting part that limits the range of rotational movement of the carriage drive unit 30 is disposed to the main carriage 31 in the foregoing specifically described embodiment, but is disposed to the sub-carriage 32 in one or more embodiments.

In addition, the printhead 13 in the foregoing embodiment specifically described is a serial impact dot matrix printhead, but the type of printhead 13 disposed to the carriage 21 of the printer 1 is not so limited.

In some embodiments, the main carriage carrying the printhead slides against the print medium conveyed over the platen, and moves toward or away from the platen tracking the thickness of the print medium. The printhead is therefore moveable toward or away from the platen according to the thickness of the print medium by means of a simple configuration, without using, in one or more embodiments, a sensor or an additional motor.

In some embodiments, the main carriage is supported on the carriage drive unit and pivotable around a parallel axis that is parallel to the axis of the carriage guide shaft. Therefore, depending on the thickness of the print medium, the main carriage is displaced toward or away from the platen while pivoting to remain in the same posture. The printhead mounted on the main carriage therefore also moves toward or away from the platen while remaining in the same posture. As a result, it is possible to avoid a drop in print quality because it is possible to suppress or prevent tilting of the printhead relative to the printing surface of the print medium when the printhead is moved toward or away from the platen and the gap between the printhead and the print medium is held constant.

In some embodiments, a guide mechanism guides the main carriage toward and away from the platen. By using such a guide mechanism, it is possible to easily hold the posture of the main carriage in a specific posture. Therefore, it is possible to reliably suppress or prevent tilting of the printhead mounted on the main carriage relative to the printing surface of the print medium conveyed over the platen.

In some embodiments, the guide mechanism includes a guide member parallel to the carriage guide shaft, and a sub-carriage supported on the carriage drive unit while being pivotable around the axis of the carriage guide shaft independently of a rotational movement of the carriage drive unit about the axis of the carriage guide shaft. Thus, the sub-carriage remains in the same posture irrespective of a change in the posture of the carriage drive unit even when the carriage drive unit pivots about the axis of the carriage guide shaft. Therefore, the main carriage slidable relative to the sub-carriage is moveable toward and away from the platen without changing the posture of the main carriage.

In some embodiments, a first urging member urges the main carriage toward the sub-carriage so that the main carriage slides against a slide guide surface of the sub-carriage, which further ensures that the main carriage is moveable toward and away from the platen without changing the posture of the main carriage.

In some embodiments, the carriage drive unit has a bushing through which the carriage guide shaft passes and the sub-carriage has an attachment part with a curved inside surface that fits at least partially to the annular outside surface of the bushing. Thus, the sub-carriage is supported to be pivotable around the axis of the carriage guide shaft independently of a rotational movement of the carriage drive unit about the axis of the carriage guide shaft.

In some embodiments, a pivot range limiting part contacts the carriage drive unit and limits the range of rotational motion of the carriage drive unit around the axis of the carriage guide shaft. Thus, it is possible to prevent the main carriage from contacting the platen when the carriage drive unit pivots about the carriage guide shaft toward the platen.

In some embodiments, the pivot range limiting part has a support shaft, and an eccentric bushing that is rotatably attached to the support shaft. Thus, the range of rotational motion of the carriage drive unit around the axis of the carriage guide shaft is adjustable by rotating the eccentric bushing.

In some embodiments, the carriage drive unit is movable in the axial direction of the carriage guide shaft together with the sub-carriage which is guided by the guide member. Thus, the printhead is enabled to print on the print medium while moving hi-directionally perpendicularly to the media conveyance direction.

In some embodiments, a second urging member urges the main carriage toward the platen in a rotational direction around the axis of the carriage guide shaft to further ensure that the main carriage moves toward and away from the platen tracking the thickness of the print medium.

In some embodiments, the main carriage has a carriage base to which the printhead is mounted, and a mask affixed to the carriage base. The mask has an opening through which the head surface of the printhead is exposed to the platen, and the end surface of the mask facing the platen side is a sliding surface that slides against the print medium conveyed over the platen. Thus, the distance between the end surface of the mask and the head surface of the printhead is the gap between the printing surface of the print medium conveyed over the platen and the head surface of the printhead, and is held constant.

In some embodiments, a printer has a printhead and the platen gap adjustment mechanism described above. Thus, it is possible to suppress variation in the print quality even when the thickness of the print medium conveyed over the platen changes.

Although various embodiments have been described, it will be apparent that the embodiments may be varied in many ways. Such variations are intended to be included within the scope of the following claims.

What is claimed is:

1. A platen gap adjustment mechanism, comprising:

a carriage guide shaft;

a carriage drive unit that is supported on the carriage guide shaft and pivotable around an axis of the carriage guide shaft;

a main carriage that is supported on the carriage drive unit, pivotable around a parallel axis that is parallel to the axis of the carriage guide shaft, and configured to carry a printhead for printing on a print medium conveyed along a media conveyance path between the printhead and a platen; and a sub-carriage supported on the carriage drive unit and pivotable around the axis of the carriage guide shaft independently of a rotational movement of the carriage drive unit about the axis of the carriage guide shaft;

wherein the main carriage is slidable on the sub-carriage toward and away from the platen.

2. The platen gap adjustment mechanism of claim 1, further comprising:

a guide member which is disposed parallel to the carriage guide shaft, and along which the sub-carriage is slidable.

3. The platen gap adjustment mechanism of claim 1, further comprising:

a first urging member that urges the main carriage toward the sub-carriage so that the main carriage slides against the sub-carriage.

4. The platen gap adjustment mechanism of claim 1, wherein:

the carriage drive unit has a bushing through which the carriage guide shaft passes; and the sub-carriage has an attachment part with a curved inside surface that fits at least partially to an annular outside surface of the bushing.

5. The platen gap adjustment mechanism of claim 1, further comprising:

a pivot range limiting part configured to contact the carriage drive unit and limit a range of rotational motion of the carriage drive unit around the axis of the carriage guide shaft.

6. The platen gap adjustment mechanism of claim 5, wherein:

the pivot range limiting part has a support shaft, and an eccentric bushing that is rotatably attached to the support shaft and has an outside surface as a contact surface configured to contact the carriage drive unit; and the range of rotational motion of the carriage drive unit around the axis of the carriage guide shaft is adjustable by a rotational position of the eccentric bushing relative to the support shaft.

7. The platen gap adjustment mechanism of claim 2, wherein: the carriage drive unit is movable in an axial direction of the carriage guide shaft; and the sub-carriage is slidable along the guide member while being moveable with the carriage drive unit in the axial direction of the carriage guide shaft.

8. The platen gap adjustment mechanism of claim 1, further comprising: a second urging member configured to urge the main carriage toward the platen in a rotational direction around the axis of the carriage guide shaft.

9. The platen gap adjustment mechanism of claim 1, wherein: the main carriage is slidable on the sub-carriage toward and away from the platen without changing a posture of the main carriage.

10. The platen gap adjustment mechanism of claim 1, wherein: the carriage guide shaft is configured to extend perpendicularly to a media conveyance direction that passes over the platen.

11. The platen gap adjustment mechanism of claim 1, wherein the carriage guide shaft has a circular cross section.

12. The platen gap adjustment mechanism of claim 1, wherein the carriage drive unit moves relative to the carriage drive shaft.

13. The platen gap adjustment mechanism of claim 1, wherein the carriage drive unit is pivotable about the carriage guide shaft.

* * * * *